US008850855B2

(12) United States Patent
Kim et al.

(10) Patent No.: US 8,850,855 B2
(45) Date of Patent: Oct. 7, 2014

(54) COMPOSITE LAUNDRY TREATING APPARATUS WITH MAIN AND SUB CABINETS

(75) Inventors: Young Soo Kim, Changwon-si (KR); Seong Hae Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1272 days.

(21) Appl. No.: 12/308,689

(22) PCT Filed: Jun. 25, 2007

(86) PCT No.: PCT/KR2007/003072

§ 371 (c)(1), (2), (4) Date: Oct. 22, 2009

(87) PCT Pub. No.: WO2008/002047

PCT Pub. Date: Jan. 3, 2008

(65) Prior Publication Data

US 2010/0147040 A1 Jun. 17, 2010

(30) Foreign Application Priority Data

Jun. 30, 2006 (KR) ..... 10-2006-0060268

(51) Int. Cl.
*D06F 73/02* (2006.01)
*D06F 58/10* (2006.01)

(52) U.S. Cl.
CPC ..... *D06F 58/10* (2013.01); *D06F 73/02* (2013.01)
USPC ..... 68/5 C; 68/6

(58) Field of Classification Search
CPC ..... D06F 73/02; D06F 58/10
USPC ..... 68/5 C, 5 R, 6, 15, 222; 38/1 A
See application file for complete search history.

(56) References Cited

U.S. PATENT DOCUMENTS

| | | | | |
|---|---|---|---|---|
| 3,861,179 | A | 1/1975 | Orchard | |
| 3,899,108 | A | 8/1975 | Frauendorf | |
| 5,305,484 | A * | 4/1994 | Fitzpatrick et al. | 8/149.3 |
| 5,359,786 | A | 11/1994 | Vierling | |
| 6,425,192 | B2 * | 7/2002 | Arrieta et al. | 34/486 |
| 2004/0134237 | A1 * | 7/2004 | Sunshine et al. | 68/3 R |
| 2006/0090524 | A1 | 5/2006 | Jeon et al. | |

FOREIGN PATENT DOCUMENTS

| | | | |
|---|---|---|---|
| DE | 100 21 011 | 10/2001 | |
| EP | 0122569 A2 * | 10/1984 | D06F 73/02 |
| EP | 0 324 589 A1 | 7/1989 | |
| EP | 0816552 | 1/1998 | |
| EP | 1 146 161 | 10/2001 | |

(Continued)

OTHER PUBLICATIONS

JP 03-075003 English Translation.*

(Continued)

*Primary Examiner* — Joseph L Perrin
(74) *Attorney, Agent, or Firm* — McKenna Long & Aldridge LLP

(57) ABSTRACT

The present invention relates to a laundry treating apparatus, including a cabinet having a main space selectively in communication with an outside of the laundry treating apparatus with a door for holding laundry, a steam generator provided to the cabinet for supplying steam to the main space, and at least one steam outlet in the cabinet for selective supply of the steam from the steam generator to an outside of the laundry treating apparatus.

7 Claims, 2 Drawing Sheets

(56) References Cited

FOREIGN PATENT DOCUMENTS

| | | | | | |
|---|---|---|---|---|---|
| EP | 1 586 691 | | 10/2005 | | |
| EP | 1586691 | A2 * | 10/2005 | ..... | D06F 58/10 |
| GB | 2459532 | A * | 11/2009 | ..... | D06F 58/10 |
| JP | 03-075003 | | 3/1991 | | |
| JP | 03075003 | A * | 3/1991 | ..... | A47B 61/00 |
| JP | 7-148394 | | 6/1995 | | |
| JP | 09-038400 | | 2/1997 | | |
| KR | 20-1996-0010694 | | 8/1995 | | |
| WO | WO 2006/019361 | | 2/2006 | | |

OTHER PUBLICATIONS

EP 1 586 691 English Translation.*

* cited by examiner

COMPOSITE LAUNDRY TREATING APPARATUS WITH MAIN AND SUB CABINETS

This application is a national stage entry of International Application No. PCT/KR2007/003072, filed Jun. 25, 2007, and claims the benefit of Korean Application No. 10-2006-0060268, filed in Korea on Jun. 30, 2006, and is hereby incorporated by reference for all purposes as if fully set forth herein.

TECHNICAL FIELD

The present invention relates to laundry treating apparatus. More specifically, the present invention relates to a laundry treating apparatus which has composite functions, or serves as a plurality of laundry treating apparatuses.

BACKGROUND ART

In general, the laundry treating apparatus includes all devices for managing or treating laundry like homes or a laundry shops, such as washing, drying, removal of creases, and so on of laundry and beddings.

For an example, the laundry treating apparatuses are washing machines for washing laundry, dryers for drying the laundry, washing and drying machines having both a washing function and a drying function, refreshers for refreshing the laundry, presses for removal of creases from the laundry, or forming pleats required for the laundry, and steamer for removal of unnecessary creases from the laundry.

The refresher, for making the laundry more comfortable or refreshing, performs functions of drying the laundry, supplying aroma to the laundry, preventing laundry from generating static electricity, removing the creases from the laundry, and so on. Many refreshers are being supplied to the North American market.

Many steamers, appliances in general merely for supplying steam to the laundry for removing the creases from the laundry, are supplied through T.V. home-shoppings, and the like, for removal of the creases from fine laundry, because, different from general press, a hot plate is not brought into contact with the laundry.

In the meantime, currently, many washing machines, particularly, drum type washing machines having steam generators, are being supplied. That is, products are spotlighted, which have washing effects maximized by supplying steam to laundry before and after the washing, or in the middle of the washing, for sterilizing, redwing a laundry wet time period, acceleration of activation of detergent, and so on.

Particularly, of the laundry treating apparatuses, though the present invention is related to the refresher, the present invention is not limited to the refresher.

A related art refresher is provided with a cabinet having a space for holding laundry formed therein. Steam is supplied to the space for removal of creases from the laundry. A source of the steam may be a steam generator in the cabinet for generating the steam, or may be a boiler on an outside of the cabinet.

DISCLOSURE OF INVENTION

Technical Problem

However, if the steam generator is provided to the cabinet of the related art refresher, the steam generator supplies steam only to the inside space, preventing the steam from utilizing for various laundry treating apparatuses.

In the meantime, because such a refresher requires one steam generator for one cabinet, it is not preferable that the user provides a plurality of refreshers to a home, or a place of business in view of cost or installation. Because, if each of the refreshers has the steam generator, a product cost will be great. Moreover, securing water supply sources for steam generating at the plurality of steam generators is also difficult.

Technical Solution

To solve the problems, an object of the present invention is to provide a laundry treating apparatus which enables composite treatment of laundry.

Another object of the present invention is to provide a laundry treating apparatus which uses steam, which enables the steam to be used at other laundry treating apparatuses.

Another object of the present invention is to provide a laundry treating apparatus which has a built-in laundry treating apparatus additionally provided therein for convenient treatment of the laundry.

Another object of the present invention is to provide a laundry treating apparatus which can be expanded to a plurality of laundry treating apparatuses for reciting product, and installation costs.

Further object of the present invention is to provide a laundry treating apparatus which can supply steam to a plurality of laundry treating apparatuses so that the inconvenience of the user in securing water supply sources can be minimized.

Still further object of the present invention is to provide a laundry treating apparatus having a hot air generator together with a steam generator for providing air, particularly, hot air to other laundry treating apparatuses.

To achieve these objects and other advantages and in accordance with the purpose of the invention, as embodied and broadly described herein, a laundry treating apparatus includes a cabinet having a main space selectively in communication with an outside of the laundry treating apparatus with a door for holding laundry, a steam generator provided to the cabinet for supplying steam to the main space, and at least one steam outlet in the cabinet for selective supply of the steam from the steam generator to an outside of the laundry treating apparatus.

Preferably, the steam outlet is formed in a supplementary space formed in the cabinet separate from the main space, and the supplementary space is provided to an inside of the door, and selectively in communication with the outside of the laundry treating apparatus with a supplementary door.

In the meantime, the supplementary space is provided with a supplementary laundry treating apparatus connected to the steam outlet for supplying the steam, and the supplementary laundry treating apparatus includes a press that uses the steam and a hot plate, or a press that uses the steam only.

Preferably, the steam generator is provided to a lower portion of the main space.

In the meantime, the device may further include a hot air supply device for supplying hot air to the main space, and preferably, the hot air supply device is provided to a lower portion of the main space.

Moreover, preferably, the main cabinet has an outlet formed therein for discharge of air from the main space to an outside of the laundry treating apparatus, and the outlet is formed in a top of the cabinet.

The device may further include a circulating flow passage for receiving the air from the main space and discharging the air to the hot air supplying device, and the hot air supply device further includes a condenser for condensing moisture in the air. The circulating flow passage may be a duct provided to one side of the main space.

In the meantime, the main space has coat hangers provided to an upper portion for hanging laundry.

In another aspect of the present invention, a composite laundry treating apparatus includes at least two cabinets each having a main space in communication with an outside of the laundry treating apparatus with a door selectively for holding laundry, and a steam generator provided to one of the cabinets for selective supply of steam to the main spaces of the cabinets.

The cabinets may include a main cabinet having the steam generator and at least one sub-cabinet adjacent to the main cabinet.

In the meantime, the main cabinet further includes a steam outlet to be opened/closed selectively for supplying the steam from the steam generator to the sub-cabinet.

Preferably, the steam outlet is in communication with a lower portion of the main space of the sub-cabinet.

The main cabinet may be further provided with a hot air supply device for selective supply of hot air to main spaces of the main cabinet and the sub-cabinet, and the hot air supply device is provided to a lower portion of the main space of the main cabinet.

The main cabinet may be further provided with a hot air outlet opened/closed selectively for supplying the hot air from the hot air supply device to the sub-cabinet.

In the meantime, the main cabinet and the sub-cabinet have outlets for discharging air from the main spaces to an outside of the laundry treating apparatus.

The device may further include a circulating flow passage provided to each of the main cabinet and the sub-cabinet for receiving the air from the main spaces and discharging the air to the hot air supplying device, and the hot air supply device further includes a condenser for condensing moisture in the air.

The circulating flow passage may be constructed of a duct provided to one side of each of the main spaces.

In the meantime, the main spaces of the main cabinet and the sub-cabinet have coat hangers provided to an upper portion for hanging laundry, respectively.

BEST MODE FOR CARRYING OUT THE INVENTION

Reference will now be made in detail to the specific embodiments of the present invention, examples of which are illustrated in the accompanying drawings. The present invention relates to laundry treating apparatuses, and preferably, a cabinet type laundry refresher. Therefore, though the laundry treating apparatus described hereinafter is based on such a refresher, the present invention is not limited to this.

Figure 1:
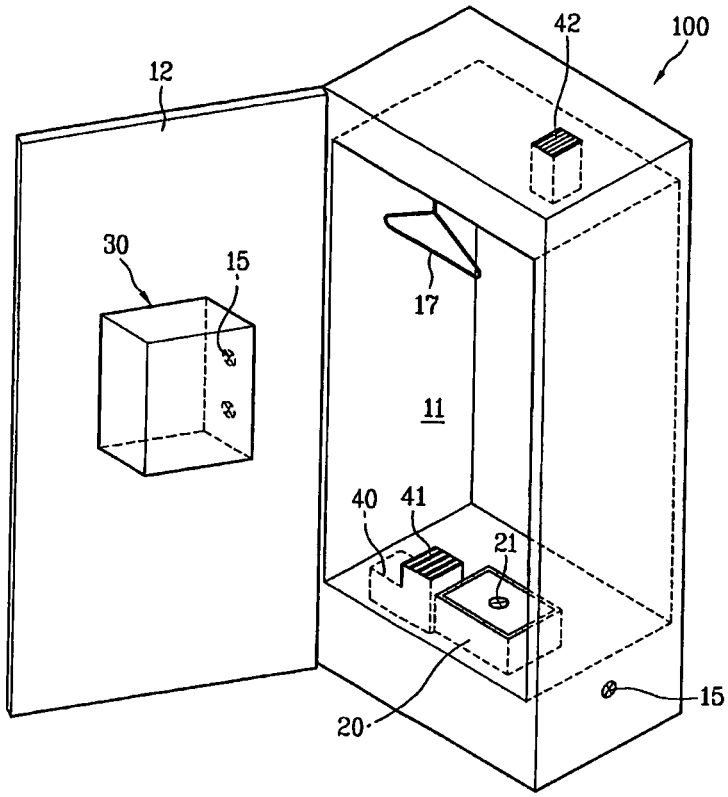
FIG. 1 illustrates a perspective view of a laundry treating apparatus in accordance with a preferred embodiment of the present invention.

FIG. 1 illustrates a perspective view of a laundry treating apparatus in accordance with a preferred embodiment of the present invention.

Referring to FIG. 1, the laundry treating apparatus includes a cabinet 100, a steam generator 20, and a steam outlet 15.

In detail, the cabinet 100 has a main space 11 isolated from an outside of the cabinet 100 for holding laundry, which can be in communication with the outside of the cabinet 100 through a door 12, selectively. That is, if the door 12 is closed, the main space 11 is isolated from the outside actually, and, if the door 12 is opened, the main space 11 is exposed to the outside. Therefore, the user opens the door 12 to place the laundry in the main space 11, and closes the door 12 when the refresher is put into operation.

The steam generator 20 is provided to the cabinet 100, for supplying steam to the main space 11. Though the steam may be water vapor, it is preferable that the steam is a steam with a temperature higher than a preset temperature generated by heating water.

It is preferable that the steam generator 20 sprays the steam to the main space 11 through a spray hole 21. It is preferable that the steam generator 20 has a water tank for holding water required for generating the steam. The water tank may be connected to an external hydrant, or filled with water by the user. If the water tank is provided with a condenser to be described later, water condensed at the condenser may be provided to the water tank. The steam generator 20 may be provided with a heater (not shown) for heating the water to generate the steam.

In the meantime, it is preferable that the steam generator 20 of the present invention can supply the steam to other spaces, or external spaces, other than the main space 11. To make this system available, it is preferable that the cabinet 100 has at least one steam outlet 15 for supplying the steam to an outside of the cabinet 100, selectively.

Though not shown, the steam outlet 15 is connected to the steam generator 20, and may be provided to a side of the cabinet 100. FIG. 1 illustrates the steam outlet 15 provided to a right side of the cabinet 100. The steam outlet 15 will be connected to the steam generator 20 with a steam flow passage (not shown). The steam flow passage may be provided to an inside of a wall of the cabinet 100, or along the inside wall.

Figure 2:
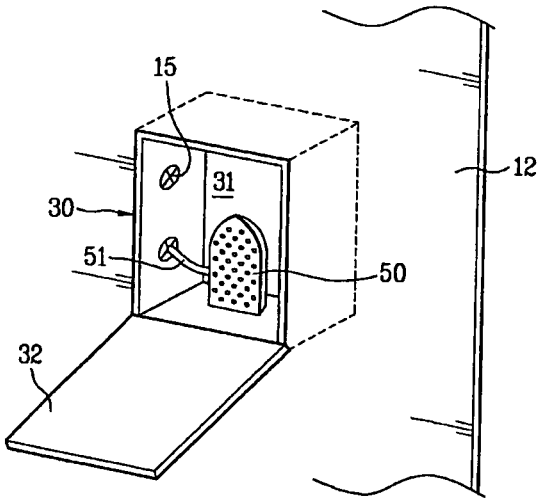
FIG. 2 illustrates a partial enlarged perspective view of FIG. 1.

Moreover, referring to FIGS. 1 and 2, the steam outlet 15 may be provided to a supplementary space 31 provided to the cabinet 100 isolated from the main space 11. The supplementary space 31 may be formed with a separate supplementary cabinet 30.

The supplementary space 31 may be formed on an inside of the door 12. That is, the supplementary space 31 may be formed as a home bar type of a refrigerator. In this case, the supplementary space 31 can be in communication with an outside of the cabinet 100 through a supplementary door 32, selectively.

FIG. 2 illustrates the supplementary door 32 rotatably connected to a lower portion of a front of the supplementary cabinet 30. However, the mounting of the supplementary door 32 is not limited to this, but the supplementary door 32 may be hinged to one side of the front of the supplementary cabinet 30. By using this supplementary space, the user may use the steam for the separate supplementary laundry treating apparatus, regardless of supply of the steam to the main space.

In the meantime, FIG. 2 illustrates a press 50 provided in the supplementary space 31. The press 50 may be one that uses steam and a hot plate, or uses steam, only. Since the press uses steam in any case, the press 50 may be connected to the steam outlet 15 with a steam hose 51. Therefore, if the press 50 is provided in the supplementary space 31 in a state the press 50 is always connected to the steam hose 51, the user can press the laundry with the steam easily without providing a separate steam supply source.

In the supplementary space 31 excluding the press 50, there may only be the steam hose 51 connected to the steam outlet 15. That is, if necessary, the steam hose 51 may be connected to the separate supplementary laundry treating apparatus, or the steam cleaner, or the like, for expanding fields of application of the steam.

For an example, the user is required to deodor from or sterilizing cleaning of beddings, or curtain, or the like by using the steam. In this case, if the cabinet 100 is provided to a bedroom, or the like, the user can make such functions available just by connecting a separate steam sprayer (not shown) to the steam hose 51.

This makes additional effects available, in which by improving a performance of the steam generator 20 which generates the steam, more powerful sterilizing cleaning and the like are made available. Because, in order to make a steam cleaner or the like movable, a size or a capacity of the steam generator 20 can not, but be limited. However, in the present invention, the steam generator 20 can be a built-in type provided in the cabinet, design of a steam generator 20 of which capacity and performance is improved can be possible, which makes a steam cleaner of an improved performance available, easily.

In the meantime, since the present invention is suitable to a laundry treating apparatus, particularly, to a laundry refresher, it is preferable that coat hangers 17 are provided in the cabinet 100 for hanging laundry.

Referring to FIG. 1, it is preferable that the steam generator 20 is provided in the cabinet 100, and it is preferable that the steam generator 20 is provided at a lower portion of the main space 11. Of course, location of mounting of the steam generator 20 is not limited to this, but it is preferable that the steam generator 20 is provided to the lower portion of the main space 11, taking that the steam has a high temperature into account. Because it is more preferable that the steam spray hole 21 is provided to the lower portion of the main space 11.

That is, if the steam is sprayed from the steam spray hole 21 at the lower portion of the main space 11, the high temperature steam, lighter than surrounding air, will rise up, to supply the steam to the laundry in the main space 11, more effectively. However, a plurality of the steam spray holes 21 may be provided to an upper portion or sides.

In the meantime, for refresh of the laundry, it is preferable that hot air is also supplied to the main space 11, rather than supplying the steam, only. That is, though by supplying the steam to the laundry, the laundry may be sterilized, deodored, or have the creases removed therefrom, more preferably, the hot air may also be supplied, because removal of moisture from the laundry or the main space 11 is required.

The hot air is not required to supply in association with the steam without fail. Particularly, in a case the laundry is dried in a damp weather, the laundry may be refreshed by providing the hot air to the laundry.

The hot air is lighter than surrounding air, to rise up. Therefore, it is preferable that a hot air supply device 40 is provided to the lower portion of the main space 11 for supplying the hot air to the main space 11.

In this case, it is preferable that the hot air discharged to the main space 11 through an outlet 41 of the hot air supply device 40 evaporates moisture from the laundry, to be turned into humid air, and discharged to an outside of the main space 11. Therefore, in order to form a flow passage for smooth flow of the air, it is preferable that an outlet 42 is formed in a top of the main space 11 for discharge of the air.

In the meantime, it is preferable that the humid air is discharged to an outside of a room through the outlet 42. For this, a pipeline (not shown) that makes the outlet 42 in communication with the outside of the room is required, additionally.

Figure 3:
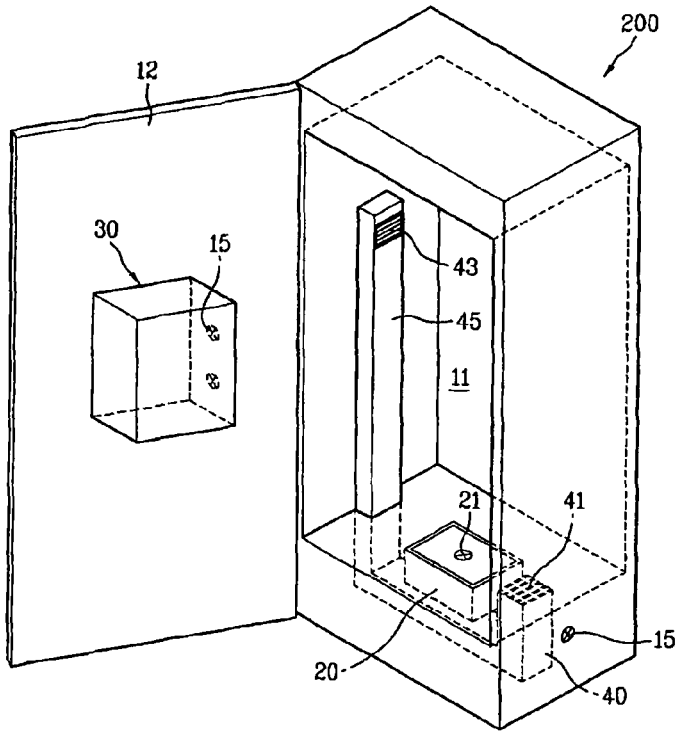
FIG. 3 illustrates a perspective view of a laundry treating apparatus in accordance with another preferred embodiment of the present invention.

Another preferred embodiment of the present invention will be described with reference to FIG. 3.

A second preferred embodiment of the present invention may have a system identical to the foregoing embodiment. However, the embodiment is different from the foregoing embodiment in that an air circulating flow passage is formed in the main space, additionally.

That is, though the foregoing embodiment has air discharged from the hot air supply device 40 to an outside of the main space 11, the embodiment has air discharged from the hot air supply device 40 introduced to the hot air supply device 40, again.

For this, the hot air supply device 40 of the embodiment further includes a condenser (not shown) for condensing moisture in the air.

Accordingly, though not shown, the hot air supply device 40 further includes a fan for generating an air flow, and a heater for heating the air. That is, air having moisture removed therefrom at the condenser is heated at the heater and discharged to the main space 11 through the outlet 41. The hot air makes the moisture to evaporate from the laundry, to be turned into humid air, and is introduced to the hot air supply device 40 again through an inlet 43.

The hot air, introduced into the hot air supply device 40 again, passes through and has the moisture removed therefrom at the condenser, is heated again, and is discharged through the outlet 41. Such a series of air flow is caused by the fan (not shown) provided to the hot air supply device 40.

In the meantime, it is preferable that the inlet 43 is formed in the top of the main space 11, for smooth air flow.

Such an air circulating flow passage may include a duct 45 on one side of the main space 11. The inlet 43 may be formed at an upper portion of the duct 45. Of course, though not shown, sixth an inlet 43 may also be formed in the middle of the duct 45.

In the meantime, it is preferable that the inlet 43 is formed opposite to the outlet 41 with reference to the main space 11. That is, it is preferable that there is a space between the two, because it is preferable that the air from the outlet 41 is brought into contact with the laundry in the main space 11 once, and, then, is introduced into the inlet 43.

In this case, the inlet 43 may not be provided to the duct 45. That is, the air may be introduced into the hot air supply device 40 directly without passing through the duct. In this instance, the inlet 43 may be provided to the lower portion of the main space 11. Therefore, this case has an effect of preventing a volume reduction of the main space 11 caused by the duct 43.

In the meantime, sizes of the duct 45, the inlet 43, and the outlet 41 may vary with a capacity of the hot air supply device 40.

Another preferred embodiment of the present invention will be described in detail with reference to FIG. 4.

The embodiment is characterized in that single laundry treating apparatus is expanded to a plurality of laundry treating apparatuses. However, the single laundry treating apparatus may have a system identical to the foregoing embodiments, basically.

The single laundry treating apparatus of the embodiment includes a main cabinet, and at least one sub-cabinet adjacent to the main cabinet. It is preferable that the main cabinet and the sub-cabinet have the same exteriors for beauty of an outside appearance.

Figure 4:
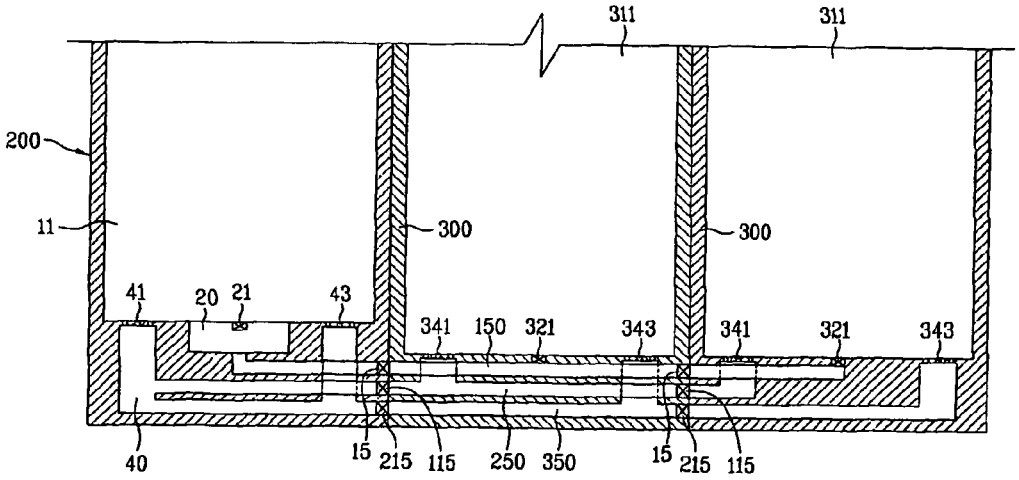
FIG. 4 illustrates a section of a composite laundry treating apparatus in accordance with another preferred embodiment of the present invention.

As one example of the embodiment, FIG. 4 illustrates a composite laundry treating apparatus having one main cabinet and two sub-cabinets. That is, FIG. 4 illustrates a composite laundry treating apparatus which an expansion of one laundry treating apparatus.

In this instance, the main cabinet can be the laundry treating apparatus in the foregoing embodiments. However, the laundry treating apparatus of the embodiment is different in that the steam outlet 15 is provided to one side of the cabinet 100. Therefore, alike the main cabinet, the sub-cabinet has a main space isolated from an outside of the sub-cabinet, which is in communication with the outside through a door.

In the embodiment, the main cabinet 200 is provided with a steam generator 20, for supplying the steam, not only to the main space 11, but also to the sub-cabinet 300. For this, the main cabinet 200 is provided with a steam outlet 15.

Of cause, in order to supply the steam to the sub-cabinet 300 through the steam outlet 15, it is required that the sub-cabinet 300 is provided with a steam flow passage 150. Preferably, the steam flow passage 150 has a steam spray hole 321 formed therein for spraying the steam to the main space 311 of the sub-cabinet 300.

That is, the steam outlet 15 is in communication with the main space 311 of the sub-cabinet, preferably with a lower portion of the main space 311.

In the meantime, FIG. 4 illustrates sub-cabinets provided on one side of the main cabinet 200. However, different from this, the sub-cabinets may be provided to opposite sides of the main cabinet 200, respectively. Such a change of installation can be made available easily by changing a location of the steam outlet 15 of the main cabinet 200.

The embodiment enables to expand a laundry treating apparatus having a steam generator 20 to a composite laundry treating apparatus. That is, a plurality of cabinets having no steam generators are connected to the main cabinet having the steam generator 20, to expand the laundry treating apparatus to the composite laundry treating apparatus. In this instance, what is required for the sub-cabinet 300 is only provision of a steam flow passage 150 for flow of the steam.

In the meantime, the main cabinet 200 may be provided, not only with the steam generator 20, but also with the hot air supply device 40, which has been described with reference to FIGS. 1 to 3.

However, in the embodiment, the hot air from the hot air supply device 40 is supplied, not only to the main cabinet 200, but also to the sub-cabinet 300.

That is, the main cabinet 200 has, not only the steam outlet 15, but also at least one hot air outlet 115. Of coarse, depending on closing/opening of the hot air outlet 115, the hot air is supplied to the main space 311 of the sub-cabinet 300, selectively.

In this case, it is preferable that the sub-cabinet 300 is provided with a hot air flow passage 250 in communication with the hot air outlet 115, with an outlet 341 for supplying the hot air to the sub-cabinet 300.

In the meantime, depending on a form of a hot air circulation, there may be an outlet (not shown) in a top of the main space 311 of the sub-cabinet 300 for discharging air from the main space 311 to an outside of the main space 311. In this system, external air will be introduced into the hot air supply device 40 of the main cabinet 200, the hot air will be supplied to the main cabinets 11, and 311, and humid air will be discharged from the outlets in the cabinets 200 and 300.

Moreover, in the embodiment, the hot air supply device 40 may further include a condenser (not shown). This system has been described with reference to FIGS. 1 to 3, already. In this case, it is preferable that the sub-cabinet 300 further includes a condensing flow passage 350 for recovery of the air from the main space 311. The condensing flow passage has an inlet 343 for introduction of the air thereto.

That is, the air is introduced to the hot air supply device 40 of the main cabinet 200 through the condensing flow passage 350 from the main space 311 of the sub-cabinet 300. The moisture will be removed from the air by the condenser of the hot air supply device 40, and the air will be heated again, and supplied to the main spaces of the main cabinets, again.

Accordingly, it is preferable that the main cabinet 200 has an air recovery hole 215 for re-introduction of the air from the sub-cabinets 300, preferably opened/closed selectively as required.

The embodiment enables to turn the laundry treating apparatus having the cabinet with the steam generator 20 and the hot air supply device 40 into a composite laundry treating apparatus having a plurality of laundry treating apparatuses.

In this case, such a composite laundry treating apparatus can be made available by only providing the flow passage 150 for supplying the steam, the flow passage 250 for supplying the hot air, and a condensing flow passage 350 for condensing moisture in the air as required, to each of the sub-cabinets 300.

In the meantime, the steam outlet 15, the hot air outlet 115, and the air recovery hole 215 can be opened/closed as required. That is, by opening/closing the steam outlet 15, the hot air outlet 115, and the air recovery hole 215 of the main cabinet 200, or the steam outlet 15, and the hot air outlet 115 of the sub-cabinet appropriately, various forms of composite laundry treating apparatuses can be made available.

For an example, it is possible that both the steam and the hot air is supplied to the main cabinet, only the steam is supplied to any one of the sub-cabinets, and only the hot air is supplied to the other one of the sub-cabinets.

Such various example of applications can be made available as a controller (not shown) of the main cabinet controls opening/closing, not only of the steam generator 20 and the hot air generator 40, but also the steam outlet 15, the hot air outlet 115, and the air recovery hole 215. In this case, opening/closing of the steam outlet 15, the hot air outlet 115, and the air recovery hole 215 can be made available with on-off valves operable with an electric signal.

In the meantime, in the foregoing embodiments, the cabinets may be clothes chests in bed rooms. In this case, it is preferable that the clothes chests are constructed of a material suitable to a humid environment, or a high temperature environment. Of curse, in a case the clothes chests are constructed of general wood, appropriate coatings may be applied.

INDUSTRIAL APPLICABILITY

A laundry treating apparatus can provide a laundry treating apparatus which permits composite treatment of laundry.

Steam from a laundry treating apparatus which uses steam can be used to other laundry treating apparatus.

By building-in a supplementary laundry treating apparatus in a laundry treating apparatus, a laundry treating apparatus can be provided, which permits the user to treat laundry conveniently.

One laundry treating apparatus can be expanded to a plurality of laundry treating apparatuses, for providing a laundry treating apparatus which can reduce product, and installation costs.

The ability of supplying steam from one steam generator to a plurality of laundry treating apparatuses permits the user to minimize inconvenience for securing water supply sources required for steam generation.

A laundry treating apparatus more convenient to use can be provided by providing air, specifically, hot air generator to the laundry treating apparatus together with the steam generator.

Finally, a laundry treating apparatus can be provided, which can be installed, not at a laundry room, but at a bed room, easily.

The invention claimed is:

1. A composite laundry treating apparatus comprising:

a main cabinet having a main space in communication with an outside of the main cabinet through a door for holding laundry and a steam generator provided to a lower portion of the main space;

at least two sub-cabinets provided adjacent to the main cabinet each having a main space for holding laundry;

steam spray holes provided to the lower portion of the main space of the main cabinet and the main spaces of the at least two sub-cabinets respectively;

a steam flow passage provided to connect the steam spray hole of the main cabinet with the steam spray holes of the at least two sub-cabinets for supplying steam generated by the steam generator to the steam spray holes;

a first valve provided to the main cabinet, wherein the first valve is configured to open or close the steam flow passage for supplying steam generated by the steam generator to the steam flow passage; and a second valve provided to one of the sub-cabinets, wherein the second valve is configured to open or close the steam flow passage for supplying steam introduced into the steam flow passage to the other one of the sub-cabinets, wherein the main cabinet includes a controller to control the steam generator, the first steam outlet, and the second steam outlet.

2. The composite laundry treating apparatus of claim 1, wherein the main cabinet is further provided with a hot air supply device for selective supply of hot air to main spaces of the main cabinet and the at least two sub-cabinets, and the hot air supply device is controlled by the controller.

3. The composite laundry treating apparatus of claim 2, wherein the hot air supply device is provided to the lower portion of the main space of the main cabinet.

4. The composite laundry treating apparatus of claim 2, further comprising:

outlets provided to the lower portion of the main space of the main cabinet and the main spaces of the at least two sub-cabinets respectively;

a hot air flow passage provided to connect the outlet of the main cabinet with the outlets of the at least two sub-cabinets for supplying hot air generated by the hot air supply device to the outlets;

a first hot air outlet provided to the main cabinet to open or close the hot air flow passage for supplying hot air generated by the hot air supply device to the hot air flow passage; and a second hot air outlet provided to one of the sub-cabinets to open or close the hot air flow passage for supplying hot air introduced into the hot air flow passage to the other one of the sub-cabinets, wherein the first hot air outlet and the second hot air outlet are controlled by the controller.

5. The composite laundry treating apparatus of claim 2, wherein the main cabinet and the sub-cabinet have outlets for discharging air from the main spaces to an outside of the laundry treating apparatus respectively.

6. The composite laundry treating apparatus of claim 2, further comprising:

a condenser provided to the hot air supply unit;

inlets provided to the lower portion of the main space of the main cabinet and the main spaces of the at least two sub-cabinets respectively for introduction of the air in the main spaces of the main cabinet and the sub-cabinets;

a condensing flow passage provided to connect the condenser with the inlets of the main cabinet and the at least two sub-cabinets;

a first air recovery outlet provided to the main cabinet to open or close the condensing flow passage for introducing the air in the condensing flow passage to the condenser; and a second air recovery outlet provided to one of the sub-cabinet to open or close the condensing flow passage for introducing the air in the other one of the sub-cabinet to the condenser, wherein the first air recovery outlet and the second air recovery outlet are controlled by the controller.

7. The composite laundry treating apparatus of claim 1, wherein the main spaces of the main cabinet and the sub-cabinet have coat hangers provided to an upper portion for hanging laundry, respectively.

* * * * *